United States Patent [19]

Murphy

[11] Patent Number: 4,913,666

[45] Date of Patent: Apr. 3, 1990

[54] WIRING TERMINAL CONSTRUCTION

[75] Inventor: Mark A. Murphy, Franklin, Tenn.

[73] Assignee: Apcom, Inc., Franklin, Tenn.

[21] Appl. No.: 320,861

[22] Filed: Mar. 6, 1989

Related U.S. Application Data

[63] Continuation of Ser. No. 183,479, Apr. 15, 1988, abandoned, which is a continuation of Ser. No. 900,674, Aug. 27, 1986, abandoned.

[51] Int. Cl.[4] ..... H01R 4/34

[52] U.S. Cl. ..... 439/709; 439/809

[58] Field of Search ..... 439/709, 808, 809

[56] References Cited

U.S. PATENT DOCUMENTS

| | | | |
|---|---|---|---|
| 2,151,674 | 3/1939 | Adam et al. | 339/269 |
| 2,233,905 | 3/1941 | Wilson | 339/269 |
| 2,314,855 | 3/1943 | Del Camp | 339/198 R |
| 3,083,348 | 3/1963 | Crowther | 339/263 R |
| 3,431,546 | 3/1969 | Averill | 339/269 |
| 3,793,607 | 2/1974 | Smith et al. | 339/263 R |
| 4,060,305 | 11/1977 | Poliak et al. | 439/808 |

FOREIGN PATENT DOCUMENTS

| | | | |
|---|---|---|---|
| 900235 | 12/1953 | Fed. Rep. of Germany | 439/809 |
| 2432779 | 4/1980 | France | 339/198 R |
| 673907 | 6/1952 | United Kingdom | 439/809 |

*Primary Examiner*—Gary F. Paumen

*Attorney, Agent, or Firm*—Paul R. Puerner

[57] ABSTRACT

The housing for an electrical device or control has a plurality of electric terminals, each having a base into which a screw is threaded with the screw head overlying the base to clamp a wire therebetween. Each base is recessed into the housing in a cavity having one side closed by a tab bent up from the base. The housing cavity and tab prevent lateral access to the space between the screw head and base except where permitted by a hole in the tab. The hole has an inverted teardrop shape and has its longitudinal axis tilted about 20° so the larger end of the hole is further from the screw. The hole is positioned to the left of the screw (when viewed from outside the tab). As the screw is tightened the wire is forced down the tilted axis of the hole closer to the screw while friction between the screw head and the wire urges the wire further into the cavity. The base is provided with raised bumps or a recess. When the screw is tightened the wire is deformed against the bumps or into the recess.

5 Claims, 1 Drawing Sheet

WIRING TERMINAL CONSTRUCTION

This is a continuation of co-pending application Ser. No. 07/183,479 filed on Apr. 15, 1988 which is a continuation of Ser. No. 900,674 filed on Aug. 27, 1986, both of which are now abandoned.

BACKGROUND OF THE INVENTION

Various switches and electric controls have terminals to which wires are connected by turning a screw down onto the wire. The wire is usually quite stiff solid wire and must be formed into a loop surrounding the screw. This takes time and the screw can back off if the wire is moved causing an inadequate connection which can result in overheating of wire and terminal. Another prior approach utilized screws with capture washers of one type or another wherein the wire is captured beneath the washer. Here again the screw can back off and become loose if the wire is moved.

This invention relates to an improved terminal construction which does not require forming the wire into a loop and which grips the wire more firmly.

SUMMARY OF THE INVENTION

This invention provides the combination of a housing for an electrical device and a wiring terminal mounted on the housing. The terminal includes an electrically conductive base an a screw threaded into the base with the screw head overlying the base to clamp a wire therebetween. Means are provided to prevent lateral access to the space between the screw head and the base and a guide hole is provided in the means to allow lateral access to the space by inserting the bare end of the wire through the hole. The hole is located to position the wire under the screw head for engagement by the screw head when the screw is tightened so friction between the screw head and the wire forces the wire further into the hole.

Another feature of the invention is locating the means preventing access to the space between the screw head and the base so close to the screw head as to prevent passage of the wire therebetween. This insures that the screw head will clamp the wire against the base.

Still another feature of the invention is that the hole through which the wire is inserted has an inverted teardrop shape with the longitudinal axis of the hole tilted outwardly so that the large end of the teardrop is further from the screw than is the small end of the teardrop. Furthermore, as the screw is turned down, the wire in the hole is forced inwardly due to the inclined axis and the wire is forced toward the screw rather than moving away from the screw which is the usual phenomenon with wiring terminals.

The guide means with the angled teardrop opening provides several desirable functions. First it materially restricts movement of the wire relative to the screw and thus prevents loosening of the screw. As the screw is tightened down the wire is forced towards the screw due to the angled axis of the opening. Also the teardrop shape of the opening permits acceptance of wires within a range of different diameters.

Another feature of the invention is the provision of surface variations by the way of bumps or indentations on the base to be engaged by the wire when the screw is tightened to prevent outward lateral movement of the wire.

DETAILED DESCRIPTION OF THE DRAWINGS

Figure 1:
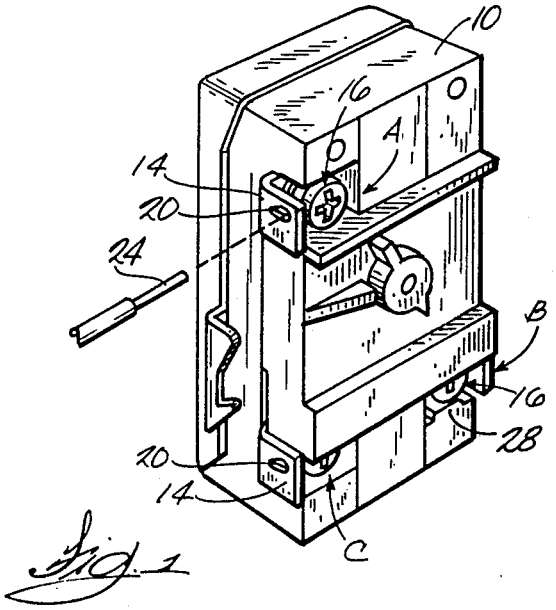
FIG. 1 is a perspective view of a control device having terminals according to this invention.

The control shown in FIG. 1 is a water heater temperature control the details of which are unimportant. The control, is shown simply to illustrate the environment of the invention and the manner in which the terminals cooperate with the housing configuration. The three terminals A, B and C are recessed into the housing 10 (mounting member) in cavities which open to the side of the housing. Each terminal includes a base 12 having a tab 14 turned up from the base 12 so as to close the open side of the terminal cavity in the housing. Each base 12 has a screw opening 15 therein. Thus, each terminal has three housing walls and a tab surrounding the screw 16 threaded into threads 17 formed in the base 12.

Figure 8:
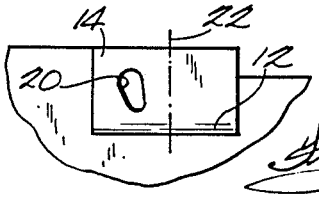
FIG. 8 is a detailed plan view taken on line 8—8 in FIG. 7.

The tab and the walls of the cavity make up means preventing lateral access to the space between the head 18 of screw 16 and the base 12. Each of terminals A, B or C the tab 14 is provided with a hole 20 which has the general shape of an inverted teardrop having its (generally vertical) longitudinal axis inclined outwardly about 20° from vertical when viewed as in FIG. 8. To state it another way (as slow viewed in FIG. 8), the longitudinal axis of teardrop hole 20 is inclined from vertical with the larger end of the hole further from a plane (not shown) which is both normal to tab 14 and includes screw axis 22. When viewed from outside the tab the hole is positioned to the left of the axis 22 of the screw so that the friction between the screw head and the wire positioned thereunder will tend to move the wire further into the space between the screw head and the base as the screw is tightened.

Figure 2:
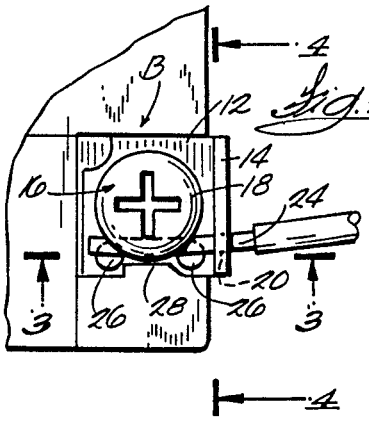
FIG. 2 is a detailed plan view of the terminal of the lower right in FIG. 1.
Figure 3:
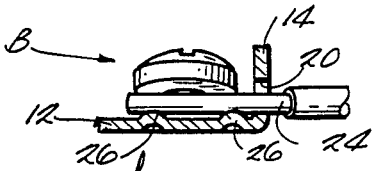
FIG. 3 is a section taken on line 3—3 of FIG. 2.
Figure 4:
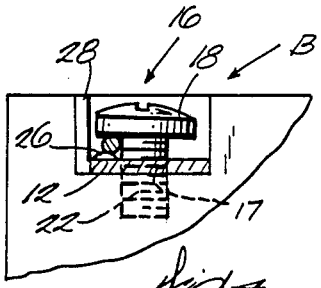
FIG. 4 is a section taken on line 4—4 in FIG. 2.

In use, the end of the insulated wire is stripped to expose a solid bare wire end 24 which is inserted through the hole 20 in the tab 14. Preferrably the bare wire is pushed into the hole until the end abuts the opposite wall of the cavity in the housing. In this position, the wire will overlie two bumps 26, 26 in the base as in FIG. 2 and 4. The adjacent cavity wall 28 between the bumps projects inwardly to prevent the wire from getting out of the space between the screw head and the cavity wall. This also positions the base end of the wire right over the two bumps 26 so that when the head 18 is turned down, it will deform the end of the wire into the space between the two bumps.

In another configuration, such as terminal C, there is no inward projection of the cavity wall but there is a series of three bumps 30 on the base to be enlarged by various size wires inserted through the hole 20. some of the bumps may not be engaged, but there are enough bumps to insure that the wire end will be deformed as the screw is turned down.

Figure 5:
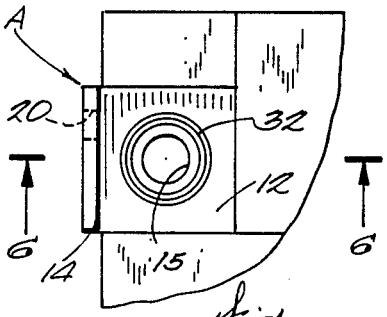
FIG. 5 is a plan view of the terminal appearing at the upper left in FIG. 1.
Figure 6:
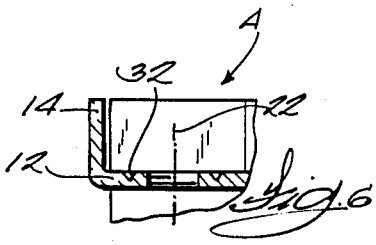
FIG. 6 is a detailed view taken on line 6—6 in FIG. 5.
Figure 7:
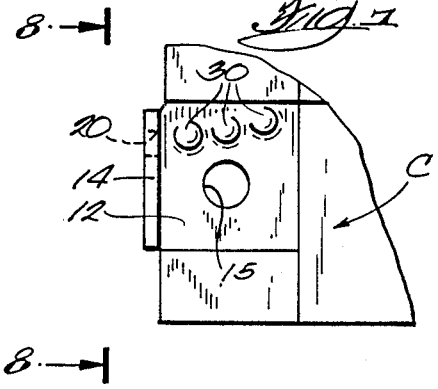
FIG. 7 is a plan view of the terminal shown at the lower left in FIG. 1 and has the screw removed to show the bumps on the base.

In FIG. 5 there are no bumps projecting upwardly from the base. Instead, there is an annular groove 32 into which a wire projecting through the hole 20 in FIG. 5 will be pressed as the screw is turned down. This clamps the end of the wire firmly.

It is noted that while the use of the tab 14 with a hole 20 therein is the preferred construction, the hole could be in the form of a slot in the tab with the sides of the slot serving to restrain movement of the wire.

I claim:

1. A wiring terminal assembly comprising:

a solid wire adapted for connection to the wiring terminal assembly;

a mounting member of plastic material;

a wiring terminal member of metal material mounted on said mounting member and having a base portion and an up-turned tab portion, said tab and base portions being integral and rigid with respect to each other, said base portion having a screw opening therein, and said tab portion having a wire restraining opening means therein, the end of said solid wire being inserted through said wire restraining opening;

a screw member having a threaded body portion and a screw head, said screw body portion threaded into said screw opening in said base portion of said wiring terminal member, said solid wire positioned adjacent said screw body portion and underneath said screw head;

said mounting member further characterized as having a cavity wall portion thereon located close enough to said screw head to prevent passage of said solid wire along said screw body and past said screw head;

said screw head on said screw acting to contact said solid wire and clamp said solid wire against said base portion of said wiring terminal member when said screw member is tightened into said screw opening in said base portion of said wiring terminal member; and said wire restraining opening means in said tab portion acting to prevent transfer of external movement of said solid wire from outside of said wire restraining opening to the portion of the wire that is clamped under the screw head of said screw member to thus prevent any tendency of the wire to loosen up from the screw due to external movement of said wire outside of said wire restraining opening.

2. A wiring terminal assembly according to claim 1 in which said wiring terminal member has a plurality of bumps formed on the base portion thereof to engage and grip the wire when the screw member is tightened into the screw opening in said base portion of said wiring terminal member.

3. A wiring terminal assembly according to claim 1 in which said wiring terminal member has an annular groove formed in the base portion thereof to engage and grip the wire when the screw member is tightened into the screw opening in said base portion of said wire terminal member.

4. A wiring terminal assembly comprising:

a solid wire adapted for connection to the wiring terminal assembly;

a mounting member of plastic material;

a wiring terminal member of metal material mounted on said mounting member and having a base portion and an up-turned tab portion, said tab and base portions being integral and rigid with respect to each other, said base portion having a screw opening therein, and said tab portion having a wire restraining opening means therein, the end of said solid wire being inserted through said wire restraining opening;

a screw member having a threaded body portion and a screw head, said screw body portion threaded into said screw opening in said base portion of said wiring terminal member, said solid wire positioned adjacent said screw body portion and underneath said screw head;

said mounting member further characterized as having a cavity wall portion thereon located close enough to said screw head to prevent passage of said solid wire member along said screw body and past said screw head;

said screw head on said screw acting to contact said solid wire and clamp said solid wire against said base portion of said wiring terminal member when said screw member is tightened into said screw opening in said base portion of said wiring terminal member; and said wire restraining opening means in said tab portion acting to prevent transfer of external movement of said solid wire from outside of said wire restraining opening to the portion of the wire that is clamped under the screw head of said screw member to thus prevent any tendency of the wire to loosen up from the screw due to external movement of said wire outside of said wire restraining opening;

said wiring terminal member being further characterized wherein said wire restraining opening means in said tab is in the form of an opening having an inverted teardrop shape with the longitudinal axis of said opening tilted outwardly from the axis of the screw so that the large end of the teardrop opening is further from the axis of the screw than is the small end of the teardrop.

5. A wiring terminal assembly comprising:

a solid wire adapted for connection to the wiring terminal assembly;

a mounting member of plastic material;

a wiring terminal member of metal material mounted on said mounting member and having a base portion and an up-turned tab portion, said tab and base portions being integral and rigid with respect to each other, said base portion having a screw opening therein, and said tab portion having a wire restraining opening means therein, the end of said solid wire being inserted through said wire restraining opening;

a screw member having a threaded body portion and a screw head, said screw body portion threaded into said screw opening in said base portion of said wiring terminal member, said solid wire positioned adjacent said screw body portion and underneath said screw head;

said mounting member further characterized as having a cavity wall portion thereon located close enough to said screw head to prevent passage of said solid wire along said screw body and past said screw head;

said screw head on said screw acting to contact said solid wire and clamp said solid wire against said base portion of said wiring terminal member when said screw member is tightened into said screw opening in said base portion of said writing terminal member;

said base portion of said wiring terminal member having surface variations which are engaged by the wire as the screw is tightened whereby the wire is deformed and gripped firmly; and said wire restraining opening means in said tab portion acting to prevent transfer of external movement of said solid wire from outside of said wire restraining opening to the portion of the wire that is clamped under the screw head of said screw member to thus prevent any tendency of the wire to loosen up from the screw due to external movement of said wire outside of said wire restraining opening;

said wiring terminal member being further characterized wherein said wire restraining opening means in said tab is in the form of an opening having an inverted teardrop shape with the longitudinal axis of said opening tilted outwardly form te axis of the screw so that the large end of the teardrop opening is further from the axis of the screw than is the small end of the teardrop, said surface variations on said base portion cooperating with said inverted teardrop opening to prevent any tendency of said solid wire to be pulled out from under said screw head.

* * * * *